US006595733B1

(12) United States Patent
Willert

(10) Patent No.: US 6,595,733 B1
(45) Date of Patent: Jul. 22, 2003

(54) FASTENER HAVING TORQUE REDUCING THREAD

(76) Inventor: Wayne A. Willert, 22 Second Ave., Port Washington, NY (US) 11050

( * ) Notice: Subject to any disclaimer, the term of this patent is extended or adjusted under 35 U.S.C. 154(b) by 0 days.

(21) Appl. No.: 09/530,538

(22) PCT Filed: Oct. 27, 1998

(86) PCT No.: PCT/US98/22776

§ 371 (c)(1),
(2), (4) Date: May 1, 2000

(87) PCT Pub. No.: WO99/23326

PCT Pub. Date: May 14, 1999

Related U.S. Application Data

(63) Continuation-in-part of application No. 08/960,686, filed on Oct. 30, 1997, now abandoned, which is a continuation-in-part of application No. 08/560,993, filed on Nov. 21, 1995, now abandoned.

(51) Int. Cl.[7] ..... F16B 39/30
(52) U.S. Cl. ..... 411/311; 411/411
(58) Field of Search ..... 52/11; 248/48.1; 411/310, 311, 914, 903, 308, 411, 417; 470/8–10

(56) References Cited

U.S. PATENT DOCUMENTS

| | | | | | |
|---|---|---|---|---|---|
| 49,466 | A | * | 8/1865 | Yapp | 248/48.2 |
| 193,626 | A | * | 7/1877 | Walker | 248/48.2 |
| 635,297 | A | * | 10/1899 | Caldwell | 411/411 |
| 735,618 | A | | 8/1903 | Tannewitz | |
| 742,525 | A | | 10/1903 | Tower | |
| 1,394,608 | A | * | 10/1921 | Davern | 411/390 |
| 1,635,871 | A | * | 7/1927 | Wilson | 248/48.1 |
| 1,710,390 | A | | 4/1929 | Vodicka | |
| 3,340,653 | A | * | 9/1967 | Steeg | 248/48.2 X |
| 3,436,877 | A | * | 4/1969 | Gunning | 52/141 |
| 3,648,560 | A | * | 3/1972 | Roser | 411/387.3 X |
| 3,909,905 | A | | 10/1975 | Giordano | |
| 3,915,418 | A | * | 10/1975 | D'Amato | 52/11 X |
| 4,093,285 | A | * | 6/1978 | Fayle | 292/251 |
| 4,453,361 | A | | 6/1984 | Hulsey | |
| 4,802,807 | A | * | 2/1989 | Offenburger et al. | 411/387 |
| 4,888,920 | A | * | 12/1989 | Marulic | 52/11 X |

(List continued on next page.)

FOREIGN PATENT DOCUMENTS

| | | | | |
|---|---|---|---|---|
| CA | 1291642 | * | 11/1991 | 52/11 |
| CH | 76348 | * | 12/1917 | 411/411 |
| DE | 3235352 | * | 3/1984 | 411/411 |
| GB | 14912 | * | 11/1884 | 248/48.2 |
| GB | 2707 | * | 2/1886 | 248/48.2 |
| GB | 26194 | * | 11/1906 | 248/48.2 |
| GB | 21050 | * | 9/1909 | 52/11 |
| GB | 2021227 | * | 11/1979 | 411/414 |

OTHER PUBLICATIONS

"Gutterscrews, A new development in hanging guttering" Indiana Builder Magazine, Oct. 1991.*

"Gutterscrews, A new development in attaching gutters!", Product Advertisement, Level Enterprises, Inc., Jun. 1994.*

Spring '96 Home Improvement Catalog p. 5, Item 124792.

*Primary Examiner*—Carl D. Friedman
*Assistant Examiner*—Naoko Slack
(74) *Attorney, Agent, or Firm*—Keusey, Tutunjian & Bitetto, P.C.

(57) ABSTRACT

A gutter fastener (10) having a first shank portion (14) with a head (12*a*) integrally formed on one end and a second shank portion (16) integrally formed with the opposite end. The first shank portion has a length (L1) substantially equal to the water collecting opening in a gutter (20), while the second shank portion has a length (L2) substantially equal to one half the length of the first shank portion. The second shank portion includes screw-like threads (50) for engaging the facial panel (24) behind a gutter arid enabling a more secure connection between the two.

16 Claims, 5 Drawing Sheets

U.S. PATENT DOCUMENTS 5,146,718 A * 9/1992 Baskett ..... 52/11
5,366,329 A 11/1994 Burgess
5,388,377 A * 2/1995 Faulkner ..... 52/11
5,400,845 A * 3/1995 Choiniere et al. ..... 144/353
5,459,965 A * 10/1995 Meckstroth ..... 52/11 X
5,549,261 A * 8/1996 Hardin ..... 248/48.2
5,570,983 A * 11/1996 Hollander ..... 411/411 X
5,667,443 A * 9/1997 Allen ..... 470/12
5,678,359 A * 10/1997 Turner ..... 52/11 X
5,704,750 A * 1/1998 Bartos et al. ..... 411/411
5,816,012 A * 10/1998 Willis ..... 411/387.1 X

* cited by examiner

FIG. 6
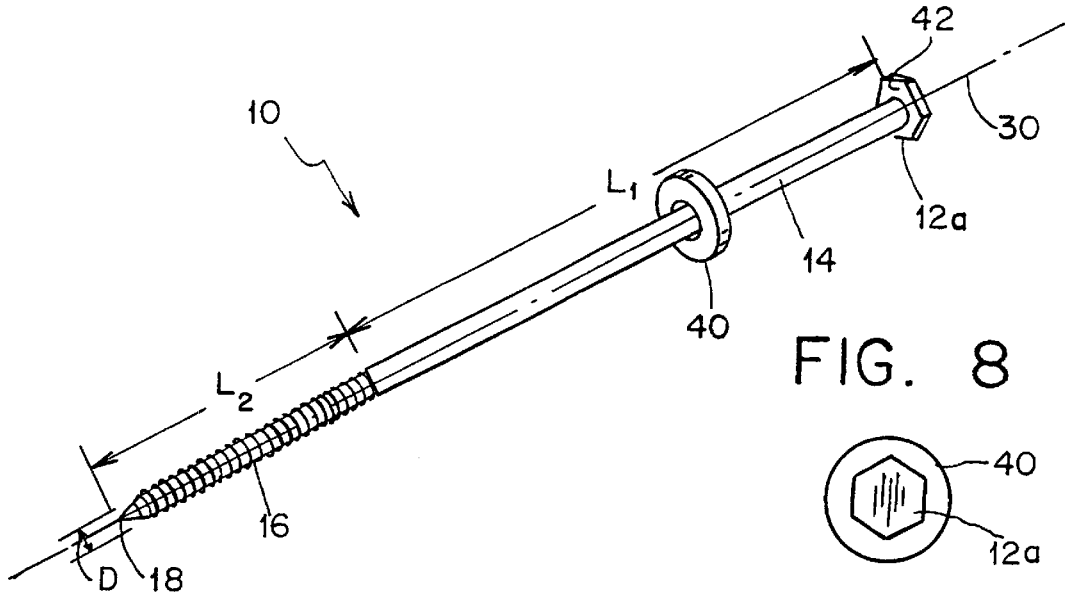
FIG. 8
FIG. 9
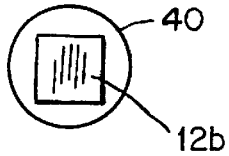
FIG. 10
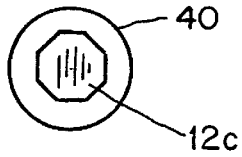
FIG. 7
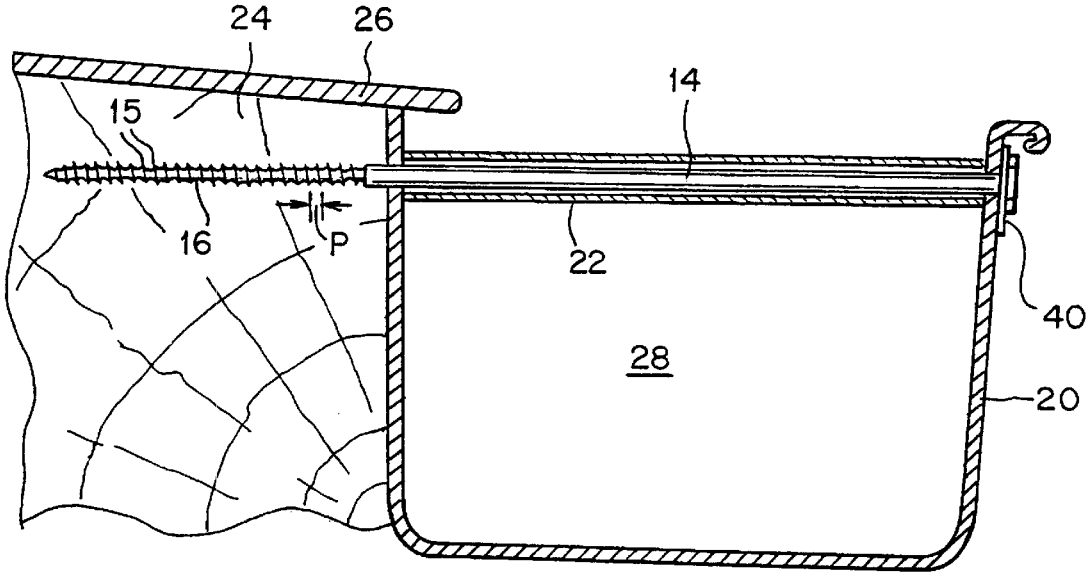

FASTENER HAVING TORQUE REDUCING THREAD

CROSS-REFERENCE TO RELATED APPLICATION

This is a Continuation-in-Part patent application of copending patent application Ser. No. 08/960,686 filed Oct. 30, 1997 now abandoned, which is a Continuation-in-Part patent application of U.S. patent application Ser. No. 08/560,993 filed Nov. 21, 1995, now abandoned.

BACKGROUND OF THE INVENTION

1. Field of the Invention

The present invention relates to roof gutters. More particularly, it relates to a roof gutter fastener and method for the application thereof, that utilizes a threaded shank portion for securing the gutter to the facia panel.

2A. Background Information

In the past, using rolled or lathed threads on such threaded prior art fasteners required pilot holes before penetrating into thin pieces of facie wood.

The developmental procedure leading to the invention of the gutter bolt is as follows. First seven inch metal threaded self tapped coated steel Phillips head 3/16" thick insulation screws were tested. Each was fastened with a #3 Phillips bit/7" lag bolt hex head.

The results are as follows. Extensive stripping of the bolt head due to the torque applied to the long steel bolt to screw it into the wood that was meant for metal installation. Even cutting a wider and deeper slotted head into steel screws did not solve the problem. Changing it into a universal Phillips or slotted head also failed to solve the problem. The force required for holding a drill that need to be applied caused a splitting of facia boards. The drill tip would pop out and then accidentally mark or puncture the gutter. Pilot holes thusly had to be drilled. The excessive damage and the amount of time required for this procedure did not make those screws commercially applicable in business. A head with more points of controlled contact is provided.

Another attempt was made to use lag bolts. Lag bolts require a pilot hole when fastening into new wood, so that there is no splitting of the facia board. Once again this is a very time consuming procedure. Also the bolt head protruded out from the front of the gutter. Quite often, the lag bolt head projected very far out in front of the gutter. The lag bolts therefore have an unsightly appearance and bring unwanted attention to the fastener for the gutter. Cutting back the heads of the lag bolt is not acceptable, even when the heads are painted to match the color of the gutter. When fastening due to torque of the tool, the fastener paint is removed and chipped away. Touch up painting is required to prevent rusting which starts occurring immediately.

In the past, the spinning motion of the fastener when making contact with the front of the gutter strips the paint off the gutter where the fastener head presses against gutter leaving raw metal exposed to the weather. Rusting occurs along with staining and marking of the gutter. These results are not acceptable due to complaints from homeowners.

Scratching of the gutter occurs when the socket wrench makes the final turns to cause the gutter to be attached to the facia. This problem can be solved by the invention if a washer is built into the head of the gutter bolt. This built-in washer has a large enough diameter to be able to shield the face of gutter from contact with the socket wrench.

After all the testing of the head and the threads was completed to achieve the proper specific requirements for performance and appearance, it was decided to use the same material as that used to manufacture most gutters, namely aluminum. The advantages are that after an installation there will be no electrolysis, rusting or corrosion by bringing into contact different types of metals. This is especially when metals are exposed to many types of weather conditions, or chemical exposure, and humidity variations, that encourage oxidation of the metals to occur.

Beginning with aluminum nails, it was decided to make them into gutter bolts. First there was the head portion and then cutting threading for making a gutter bolt. If the material was too soft, it would snap just going through 3/4" pine board. But with the use of a pilot hole, it would penetrate wood and hold formally. But the metal hardness had to be increased to go through Douglas Fir wood without using a pilot hole. Then a heat treating process was developed to harden the aluminum alloy. Further testing of the materials showed that some would drill right through 3/4" pine board but snapping would occur or heads would strip off on most of the other materials which were used and with the same results. Rods or coil aluminum was used plus heat treating application followed by specific machining techniques. Eventually, five different types of aluminum were tested with eight heat treatment processes involved with the different aluminum material before using current material. Hundreds of tests were made by drilling seven inch bolts into three-quarter inch pine boards. Then there was test drilling into Douglas Fir for the occasional situation wherein the gutter bolt hits the rafter tails that holds up the facia board.

Finally an aluminum bolt material was found that had the strength necessary to achieve the desired results.

It was impossible to locate any type of bolt system comparable to gutter bolts from any hardware stores, Fastening Co., Home Depot and even the Thomas Register, exhausting all possibilities for finding a source of supply for the gutter bolts and materials that was to be tested and then eventually finally perfected. Many types of material such as steel, aluminum, or copper, etc., from which gutters are made, or any other product in existence or similar metal used for any other fastener was unsuccessful. Attempts were made to find a manufacturer to make gutter bolts through the Yellow Pages, The Business to Business Telephone Book, and the Thomas Register, and by contacting hundreds of manufacturers. The most often heard response was "What is a gutter bolt?" After providing the manufacturer with a copy of the specifications, the response after reviewing the specification was that machining and tooling to produce this type of bolt due to length, and for the thread pitch would take a great deal of labor. New techniques and new technologies would be needed to produce this combination of length and the unique threading for the bolt. The threading was very unique and was not similar to the threads of thousands of observed wood screws. A search of this prior art found nothing comparable to the pitch, depth, and length of the threading of the inventive gutter bolt.

2B. The Prior Art

U.S. Pat. No. 3,909,905 to Giordano, discloses gutter installation tools. The invention consists of a spacer tool having a U-shaped channel and being positioned between the front and rear panels of the gutter. When the tool is in place, a conventional spike can be driven through the front gutter panel into the U-shaped channel and the rear gutter panel to fasten the gutter to the structure. Once the spike has been driven in, the tool can be removed and used again. In addition, the prior art discloses a novel spike design that adds a notch on the shaft near the head for engaging the front portion of the gutter. The notch enables a more secure coupling between the spike and the gutter.

These prior art gutter fasteners are nails that ultimately end up having to be re-secured over time. As such, the gutter partially detaches from the facia panel and thereby prevents the efficient operation of the gutters.

In addition, by providing a more secure connection between the gutter and the facia panel, the safety of the working conditions for workers in the roofing, siding and gutter fields is significantly increased. On many occasions, these workers find themselves leaning on the gutters, which causes stress on the gutter fasteners and usually requires the gutter to be re-secured. A more secure connection will alleviate this stress. Furthermore, it often happens that one of these workers loses their balance while working and grabs onto the gutter for support. With the old gutter fasteners, the weight of an adult would literally rip the gutter from the facia panel causing the worker to fall to the ground. Depending on the height of the gutter, this can be a potentially fatal circumstance. A more secure connection between the gutter and facia panel would be desirable to eliminate this danger by preventing the gutter from detaching when subject to the weight of an adult. Also, denting of gutter from hammering or re-hammering of gutter nails is prevented.

Other prior art attempts to fasten gutters are described in the Marulic U.S. Pat. No. 4,888,920, the Hardin U.S. Pat. No. 5,549,261, and the British Patent No. 2707. However, these prior art fasteners have all of the disadvantages described above.

SUMMARY OF THE INVENTION

It is an object of the present invention to provide a gutter fastener that overcomes the shortfalls of the prior art by enabling a more secure connection between the gutter and the facia panel. This more secure connection eliminates the need for subsequent re-securing of the gutter with the facia panel. This more secure connection also eliminates the need for using a pilot hole in the facia board.

According to the invention, a wood screw or gutter fastener is provided having a head portion for receiving a tool, a first shank portion integrally formed with head portion, and second shank portion integrally formed with the first shank portion.

The first and second shank portions each a have a specific length, and share a common longitudinal axis. The length of the first shank portion is such that the gutter fastener can pass through the front of a gutter and extend across the water collecting opening in the gutter. The second shank portion has a length substantially equal to one-half the length of the first shank portion. The second shank portion is threaded in a screw-like manner, and has a pointed end for facilitating the engagement of the gutter fastener with the gutter and facia panel.

It is therefore a further object of the present invention to provide a wood screw-or gutter fastener that utilizes a threaded end to secure the gutter to the facia panel.

It is another object of the invention to provide a gutter fastener that does not require additional time to install and does not require the use of a pilot hole.

A further object of the invention is to provide a wood screw or gutter fastener that eliminates the need for re-securing the gutter to the facia panel after a period of time.

It is another object of the invention to provide a wood screw or gutter fastener that operates more efficiently and reliably that the prior art gutter fasteners.

The present invention solves this prior art problem. The solution for using these bolts without pilot holes resides in cutting the threads to such a degree of pitch, curvature, height, depth, sharpness, so that the threading cuts like a drill bit and the threading holds like a wood screw. After 30 different tests, it was determined to cut eleven threads to the inch at a thread depth of one-third the gutter bolt diameter from top to bottom of thread. A steep pitch in the front of the thread is for cutting and lesser curved or shallow pitch behind the thread enables the thread to cut like a drill due to the steepest pitch and hold like a wood screw due to the shallow portion of the thread.

Threads extended from the smooth portion length and threading includes 2.5 inch cut into the seven inch length bolt. This was researched for use with fasteners of 3 different size gutters (4", 5", 6") and gives the most support to the four inch smooth portion meeting the cut portion. This is due to taking away 1/16" from actual thickness of smooth portion from cutting in threads and for fastening a gutter, example 4" gutter 2¼" passes through the ¾" standard thickness facia board with ¼" of thread still embedded in back facia. The one-half inch smooth portion is embedded into the facia with the four inch smooth portion supporting the gutter with washer hex head contacting the gutter.

For a 5" standard residential gutter, 1¼" threaded portion passes through the ¾" facia board; and ¾" threads embedded into the facia ½" threaded portion extended out from the front of the facia combined with the 4½" smooth portion as support for the gutter washer hex head.

For a 6" commercial gutter, ¼" portion passes through the facia ¾" embedded into the facia. 1½" extends out of the front of the facia with the 4½" smooth portion. The weakest point of the gutter bolt is where the threads meet the smooth portion of the gutter bolt length. As discovered with the degree of hardness of aluminum used to get the proper strength needed, it was found that bolts will not snap when in use.

The gutter bolt of the invention is 7 inch in total length and includes a 2.5 inch wood screw threaded end portion on the one-quarter inch diameter thick gutter bolt. The threading is primarily to go through the facia board and the rafter tails if necessary. The gutter bolt is of so great a strength that this fastener can hold the entire weight of gutter system without the use of a bracket system as in the prior art. A sleeve may be added but only to keep the cavity of gutter from being crushed if pressed towards the facia board. This is in case of force applied to front of gutter and is other than what gutter is designed to support.

The smooth unthreaded shank portion of the gutter bolt connects into the threaded part of the gutter bolt so as to provide the maximum strength to support the gutters. This is because all the threading is embedded into the wood so that only the smooth shank can be covered by the sleeve to the depth of the 5" cavity of the gutter.

There is no need to drive pilot holes into the facia. Due to height, depth and pitch of threaded portion, the angle of threads and sharpness of threading, the gutter bolt can penetrate the pieces of wood close to the edge of the wood without splitting. Prior art rolled or lathed wood threading fasteners are known to split the wood without first having a prior pilot hole being drilled into the wood.

As a preferred embodiment, the hexagonal shaped head, or hex head, provides six points of fastening contact on the sides of the gutter bolt head. Thus, there is substantial support even if a great torque is needed for twisting the gutter bolt fastener into the facia. Also there is no marking on the gutter outside surface by the gutter bolt fastener that occurs in conventional gutter fastener installations.

The preferred embodiment of a hex head washer combination attached to the smooth portion of the shank provides a greater holding force at the front of the gutter. Since the washer has a larger diameter than hex head diameter, the washer also prevents the socket wrench used for turning the hex head from touching the front of the gutter and from leaving a ring mark or scratch on the gutter face when securing the bolt to the gutter.

In a further embodiment, facets are added to the screw portion of the fastener part for wood screw installation to reduce the required torque. Facets are notches cut or rolled in between each thread of the fastener. Facets reduce the torque on the head, rod, threading, tools and reduce the stress on the material being fastened, such as the facia. Facets are shaped multiangle and do not exceed the highest or lowest point of the threading. They are a separate function of the screw portion. Facets are located on the remaining solid portion of the rod and between each of the threads. Facets are recessed at different angle pitches allowing the wood to pass over the highest point of the facet and to reside in the deepest most recessed portion of the notch. This relieves the stress on the wood as the fastener screws into the wood. This gives the wood a chance to expand and contract for maximum stress relief while the fastener of the invention is advancing into the wood. With the turning penetration of the threaded fastener, each individual thread allows this stress relief process to happen.

Specifically, the present invention is thusly directed to a screw-threaded portion of a wood screw or gutter bolt fastener comprising a shaft having threads thereon, and each thread having a front; said thread having a steep pitch in the front of the thread and having a shallow curved portion behind the thread; and facets comprising notches located in the shallow curved portion behind the thread.

The angle of the facet reduces stress in the wood. As the wood slides up to the next facet, it gradually builds up torque until it reaches the highest point of the facet. This equals the amount of pressure of a solid rod fastener without facets until it rolls over into the cavity of the next facet. With many facets placed on each thread having multiple threads per inch, stress relief will occur on each individual thread.

With the facets in place, the screw threaded portion of the fastener holds better within the wood. When unscrewing the threaded portion from the wood, the wood now slides up to the highest point of the facet. The wood has to overcome the maximum height of the facet.

In order to manufacture the facets in the threads according to the invention, the facets are added to the shallow portion of the thread. This requires slowing down the turning RPM of the cutting blade as it contacts the rod. This permits the cutting blade to reside in one area of the circumference of the bolt for a longer time and to make deeper cuts of random or controlled depths and sizes within the facet. Thus there can be a variable number of facets for each individual thread.

The angles of the facets vary in degrees. This allows screwing the threaded portion into the wood so as to turn the fibers with the threads. Hence the fibers of wood will conform to the low-high angles of the facets.

Facets provide a gradually sloped portion of the thread when turning the fastener clockwise into the wood. This allows fibers of the wood to travel up the least slope part of the facet to the normal pressure depth of the thread. Fibers of wood then drop off the steep end of the facet allowing expansion of the fibers of wood down into the lowest portion of the facet. This reduces the pressure and the force that are applied to the wood fibers by the solid portion in between the threads.

By having multiple facets per thread, the facets permit the wood fibers to have a constant pressure relief at all times per thread, since in one embodiment there are many facets randomly placed at different depths per thread. Wood fibers are not evenly placed on any two facets at one time allowing a multiple action for pressure release all the time. Hence, there are expansion, and contraction, of wood fibers around the threaded portion of the fastener as it penetrates into the wood. There are from 5 to 15 facets, or notches, per thread, preferably from 8 to 10 facets per thread.

With facets being notched into the shallow curved portion behind the thread, this also gives the threaded portion of the fastener a superior holding power in the wood in two ways. First, with the facets cut in between the threads, it allows wood fibers to expand into the facet cavities. Wood fibers are embedded into the facets within the threaded portion of the rod allowing the wood fibers to expand and fill in the space between the threads. Secondly, because facets are angled and sloped with a sharp drop off, when removing the fastener, the sharp drop of the facet now becomes a barrier of resistance against removal. Due to the wood fibers expanding into the facet and taking the shape of the facet, the steep angle resists the removal of the fastener due to a gripping action of the wood fibers. On the other hand, the gentle sloped area of the facet causes a much lower level of resistance by the wood fibers during insertion and advancement of the fastener.

By adding facets to the threading of wood fasteners, according to the invention, there are unique and beneficial advantages as follows. It takes less torque to install, with there being better holding of the fastener once installed into wood and with less chance of the fastener loosening. There is less chance of stripping the head off from the fastener. There is less chance of snapping the fastener. There is less wear on the tools used: slotted tip (saves on snapping), Phillips tip (saves on snapping), electric drill (less wear on the motor) and nut setter or socket (less stripping). Energy saving is due to less electricity used when installing. There is increased safety due to less force and torque used to install the fastener. There is a choice of different metals being useful, other than steel, for example aluminum, copper or whatever metal can be used depending on the weather environment or the metal specifications required. There is a better holding power on the fastener within the wood.

Utilizing a small machine shop, a cold header was built and mill cutter production was begun. First production was at a very slow pace. Improvements were made to increase production.

Three types of aluminum gutters were tested, namely narrow (0.19 to 0.20 inch), medium (0.25 to 0.27 inch), and heavy (0.30 to 0.32 inch) in diameters. Damage to a gutter has been known to occur due to the weight of the snow, the ice or the tree debris weight load. The back portion of the gutter would not remain fastened to the facia board. Trying to repair the gutter lip and the prior art hanger clip due to metal fatigue damage has made the most worn point on the hidden hanger even more worn out. This is especially true where a tremendous amount of weight and loading does occur. If the required repairs to the damaged area are neglected, the situation worsens over time. The problem of gutter loosening is well known and has existed since the beginning of the use of gutters. The present invention is a solution to this problem due to the uniqueness of gutter bolts. For example, they fasten three types of gutters with one size of fastener having adequate holding power, and not having to predrill pilot holes for the fastener gutter bolt of the invention. Refastening an existing gutter is possible without making new holes in the front and the back of the gutter or facia board. Time and money are saved by not having to refasten gutters once this gutter has been fastened by the gutter bolt of the invention. Also the very important matter of safety is emphasized by using the gutter bolt of the invention which achieves a very high degree of safety.

The gutter bolts of the invention have several important advantages. The gutter bolts have achieved significantly improved sales in spite of the cost of producing the bolt. Commercial success has been achieved with very little advertising and is the result of demonstrations of the product by the inventor, installers, homeowners, etc.

Gutter bolts can be up to five times more expensive than a prior art gutter spike, and are 1.5 times more expensive than prior art bracket systems. The savings in using gutter bolts of the invention is due to over the years not having to pay another person to renail the gutter back into position. Also there is avoiding the risk of the repair person falling to the ground in an attempt to nail back the loosened gutters. Also when nails do not grip in the same hole that was made with the original installation, the repair person would move that nail enter to the left or to the right of the existing hole for refastening of the loosened gutter. This causes additional holes in the back of gutter and in the facia board which in turn will permit water seepage to cause damage to the facia board. Also when replacing gutters in the past, it was necessary to replace facia board due to this excessive number of holes, and due to possible splitting of the wood, and water damage.

The gutter bolts of the invention can solve these problems, due to the unique operational quality of the invention not only for new installations but also for gutter spike replacement as well. It is just necessary to remove the old original gutter spike and to install a new gutter bolt through the front opening and the back opening that had been previously made by the original gutter spike and then to screw the gutter bolt snugly into the facia. If the hole in the facia board is reamed out due to the gutter spike and if the threading does not grab into the wood, one could add a one inch plastic anchor into the reamed out hole. Then install the gutter bolt. For a secure fastening installation to hold that gutter, it is no longer necessary to use the leading prior art bracket system known as the hidden hanger. This prior art bracket system screws through the back of the gutter and only clips onto the front return lip of the gutter.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views:

FIG. 6 is a perspective view of another embodiment of the gutter fastener according to the invention having the integrally attached washer at the tool receiving end of the fastener;

FIG. 7 is a partial cross-sectional view of a gutter secured to a facia panel with the gutter fastener according to the invention, and having the integrally attached washer contacting the gutter;

FIG. 8 is a top view of a fourth embodiment of the tool receiving end of the gutter fastener according to the invention, also having the integrally attached washer;

FIG. 9 is a top view of a fifth embodiment of the tool receiving end of the gutter fastener according to the invention, also having the integrally attached washer;

FIG. 10 is a top view of a sixth embodiment of the tool receiving end of the gutter fastener according to the invention, also having the integrally attached washer;

DETAILED DESCRIPTION OF PREFERRED EMBODIMENTS

Figure 1:
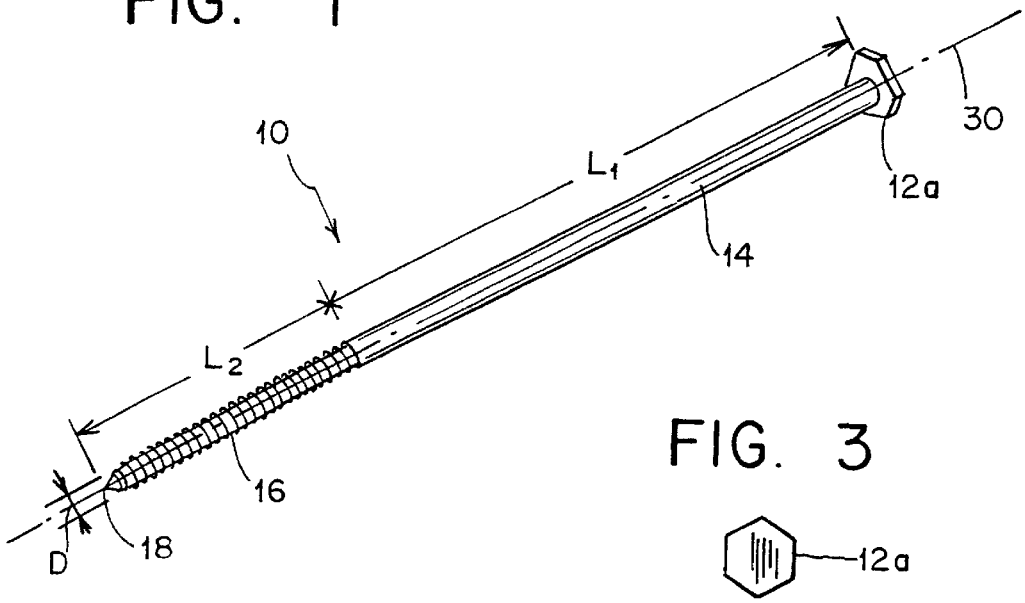
FIG. 1 is a perspective view of the gutter fastener according to the invention.
Figure 2:
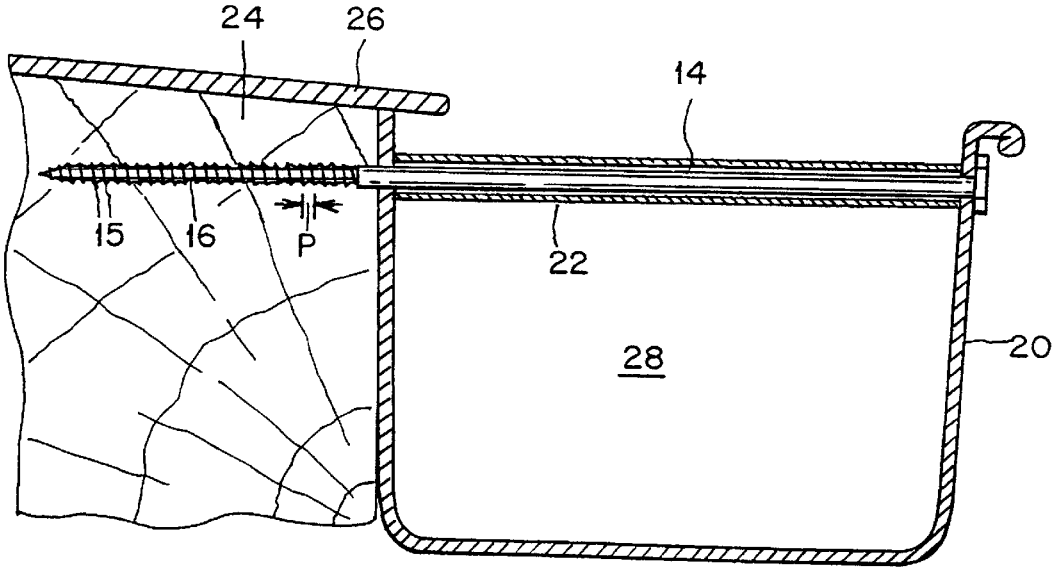
FIG. 2 is a partial cross-sectional view of a gutter secured to a facia panel with the gutter fastener according to the invention.

Turning now in detail to the drawings, FIGS. 1 and 2 show the gutter fastener 10 according to the invention. Fastener 10 has a first shank portion 14 and a second shank portion 16 integrally formed with one end of the first shank portion. A head portion 12 is integrally formed with the opposite end of first shank portion 14. First shank portion 14 and second shank portion 16 share a common central or longitudinal axis 30.

First shank portion 14 has a length $L_1$ and second shank portion 16 has a length $L_2$. Length $L_1$ is substantially equal to twice the length $L_2$. In other words, length $L_2$ is substantially equal to one-half the length $L_1$. Although other lengths could be employed for $L_1$ and $L_2$, these are the preferable lengths that enable gutter fastener 10 to operate more efficiently than other gutter fasteners.

The length $L_1$ of first shank portion 14 is such that this shank portion can completely pass through ferrule 22 and across water collecting opening 28 in gutter 20 (FIG. 2). Once installed as shown in FIG. 2, the threaded second shank portion 16 is completely secured within facia panel 24 and thereby secures gutter 20 to the facia panel. The overall length of fastener 10 is proportional to the diameter D such that an approximate ratio of 24:1 length to diameter is formed. For example, with diameter D equal to ¼", the overall length of L1 and L2 combined would be approximately 6". The overall length of fastener 10 can be in the range of 6"–8" without the head. The preferred length of second shank portion 16 is 2 inches to 2.67 inches based upon an overall length of 6 to 8 inches.

The length of fastener 10 plays an integral part in the design of the fastener. As the length is increased, the torque applied to the head when being forced into facia panel 24 causes an additional torsional stress to occur at the weakest points along fastener 10. The weakest points of fastener 10 are the point at which head 12*a* connects with first shank portion 14, and the transition point between first shank portion 14 and second shank portion 16 (i.e. where the threaded portion meets the non-threaded portion). Thus, head 12*a* can have a thickness in the range of ⅛"–½".

The total length of the gutter bolt fastener of the invention is such that the same size fastener can support a 4 inch gutter, a 5 inch gutter, or a 6 inch gutter, by itself without the use of any other fastener means.

Second shank portion 16 has an end 18 that is pointed to facilitate the initial engagement of fastener 10 with gutter 20 and facia panel 24. In addition, pointed end 18 enables the user to hammer fastener 10 through gutter 20 and into facia panel 24 to further facilitate the initial engagement.

Fastener 10 has a diameter D that can be, for example, ¼". Diameter D is chosen such that it is slightly larger that the diameter of a standard gutter nail. Thus, the current gutter nails can be replaced with gutter fastener 10 using the same hole left by the removed gutter nail.

In another embodiment of the invention, diameter D of fastener 10 can be different for first shank portion 14 and second shank portion 16. For example, the diameter of second shank portion 16 could be slightly larger that of first shank portion 14.

FIGS. 6 to 10 correspond respectively to FIGS. 1 to 5, except that in FIGS. 6 to 10 the integrally attached washer 40 is shown. Washer 40 is integrally attached to the head 12*a* on the inner surface 42 of head 12*a* such that washer 40 is located between the head and the first shank portion 14. Thus, the first shank portion 14, the washer 40 and the head 12*a* are of a unitary continuous construction having a tandem relationship to each other.

The screw-like threads 50 (FIG. 11) of second shank portion 16 have sharp edges 15, and a pitch P suitable for engaging wood. The sharp edges provide a deeper thread than that of machine threads. The thread depth for wood is enlarged to compensate for the low strength of wood in comparison to the strength of steel. Pitch P can be in a range of 1/16"–3/16" (i.e. approximately 5 to 16 threads per inch). Thus, pitch P and diameter D have a ratio such that when one increases the other increases, and vice versa. The pitch P is chosen such that it is small enough to reduce the torque needed to drive the fastener 10, without effecting the ability to apply the fastener to the wood, or causing the fastener to torsionally break at its weakest point.

The head 12*a* washer 40 combination attached to the smooth portion 14 of the shank provides a greater holding force at the front of the gutter. Since the washer 40 is circular in shape and has a larger diameter than head diameter 12*a*, the washer 40 also prevents the socket wrench used for turning the head 12*a* from leaving a ring mark or scratch on the gutter face when securing the bolt 10 to the gutter 20.

Figure 11:
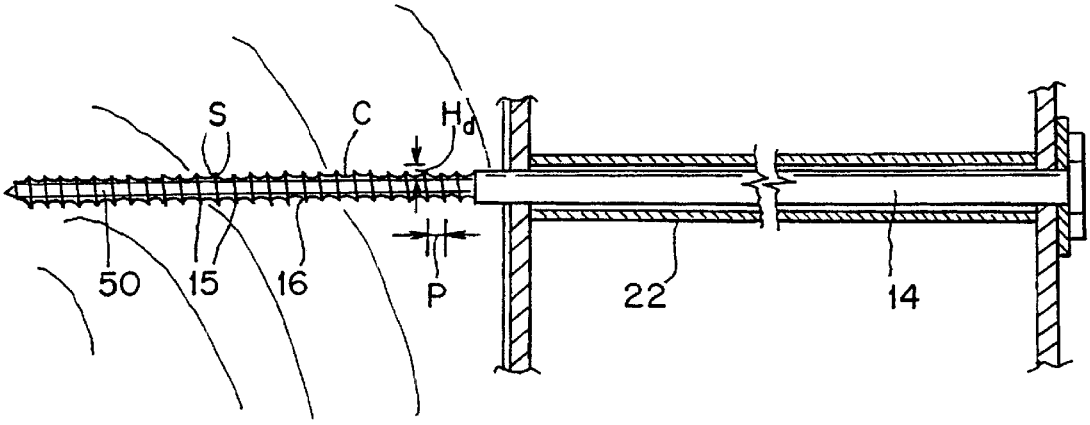
FIG. 11 is an enlarged view of the partial cross-section shown in FIG. 7 showing in detail the second shank portion.

In the past, using rolled or lathed threads on such a threaded prior art fasteners required pilot holes before penetrating into thin pieces of wood. The present invention solves this prior art problem as shown in FIG. 11. The solution for using these bolts without pilot holes resides in cutting the threads 50 to such a degree of pitch P. curvature C, height H, depth d, sharpness S, so that the threading 50 cuts like a drill bit and the threading 50 holds like a wood screw. After 30 different tests, it was determined to preferably cut eleven threads 50 to the inch at a thread depth of one-third the gutter bolt diameter D from top to bottom of thread. A steep pitch in the front of the thread is for the cutting and a lesser curved or shallow pitch portion C behind the thread enables the thread to cut like a drill due to the steepest pitch and hold like a wood screw due to the shallow portion of the thread. The height H or the depth d refers to the distance from the edge at the sharpest point of the sharpness S to the surface of the shallow pitch position C of the curvature. The shallow portion of the curvature C is concave to such a degree that preferably the radius of curvature is almost infinite and thus the shallow portion C is almost flat. The sharpness S of the thread 50 is such that the angle of S relative to C is about 90°, or preferably is a right angle of 90 degrees.

In an alternative embodiment of the invention, an oil or a TEFLON® coating (e.g. a non-stick polymer lubricant coating) or a paraffin coating can be applied to the screw-like threads of second shank portion 16 to aid in reducing friction between fastener 10 and facia panel 24, thereby reducing the torque required to drive the fastener. The screw-like threading on second shank portion 16 provides an extra secure coupling of gutter 20 with facia panel 24.

Figure 3:
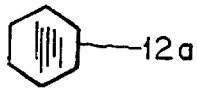
FIG. 3 is a top view of a first embodiment of the tool receiving end of the gutter fastener according to the invention.
Figures 4, 5:
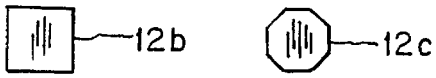
FIG. 4 is a top view of a second embodiment of the tool receiving end of the gutter fastener according to the invention.
FIG. 5 is a top view of a third embodiment of the tool receiving end of the gutter fastener according to the invention.

FIGS. 3, 4, and 5 show the first, second and third embodiments of head portion respectively. When securing fastener 10 as shown in FIG. 2, head portions 12*a*, 12*b*, and 12*c* are engaged by a manual or automatic tool operated by the user which applies the requisite rotational motion and pressure to secure gutter 20 to facia panel 24. Fastener 10 can be made from aluminum, galvanized steel, stainless steel, or any other suitable known material. Preferably the gutter bolt 10 is made from aluminum.

In an actual installation, pointed end 18 is placed against the gutter and lightly hammered through the front of the gutter and through the back of the gutter, until end 18 engages facia panel 24 under roof 26. A ferrule 22 is fit around fastener 10 before the hammer blow that penetrates the back wall of the gutter. Upon initial contact with facia panel 24, repeated light hammer blows to head portions 12*a*, 12*b*, and 12*c* will cause pointed end 18 to further penetrate facia panel 24, and the threads on second shank portion 16 will cause fastener 10 to begin to rotate in the thread direction. At this time, the user may apply a manual or electric power tool to head 12*a* and further secure fastener 10 into the facia panel.

Preferably the aluminum alloy used for the manufacture of the gutter bolt 10 is alloy number 5356-0 from AlcoTec Wire Company of Traverse City, Mich., and has the following chemical composition limits in % by weight based upon the total weight:

| Element | Minimum % | Maximum % |
|---|---|---|
| Si | 0.0 | 0.25 |
| Fe | 0.0 | 0.40 |
| Cu | 0.0 | 0.10 |
| Mn | 0.05 | 0.20 |
| Mg | 4.5 | 5.5 |
| Cr | 0.05 | 0.20 |
| Zn | 0.0 | 0.10 |
| Ti | 0.06 | 0.20 |

-continued

| Element | Minimum % | Maximum % |
|---|---|---|
| Be | 0.0 | 0.0008 |
| Aluminum | 95.34 | 93.0492 |
| TOTAL: | 100% | 100% |

Figure 12:
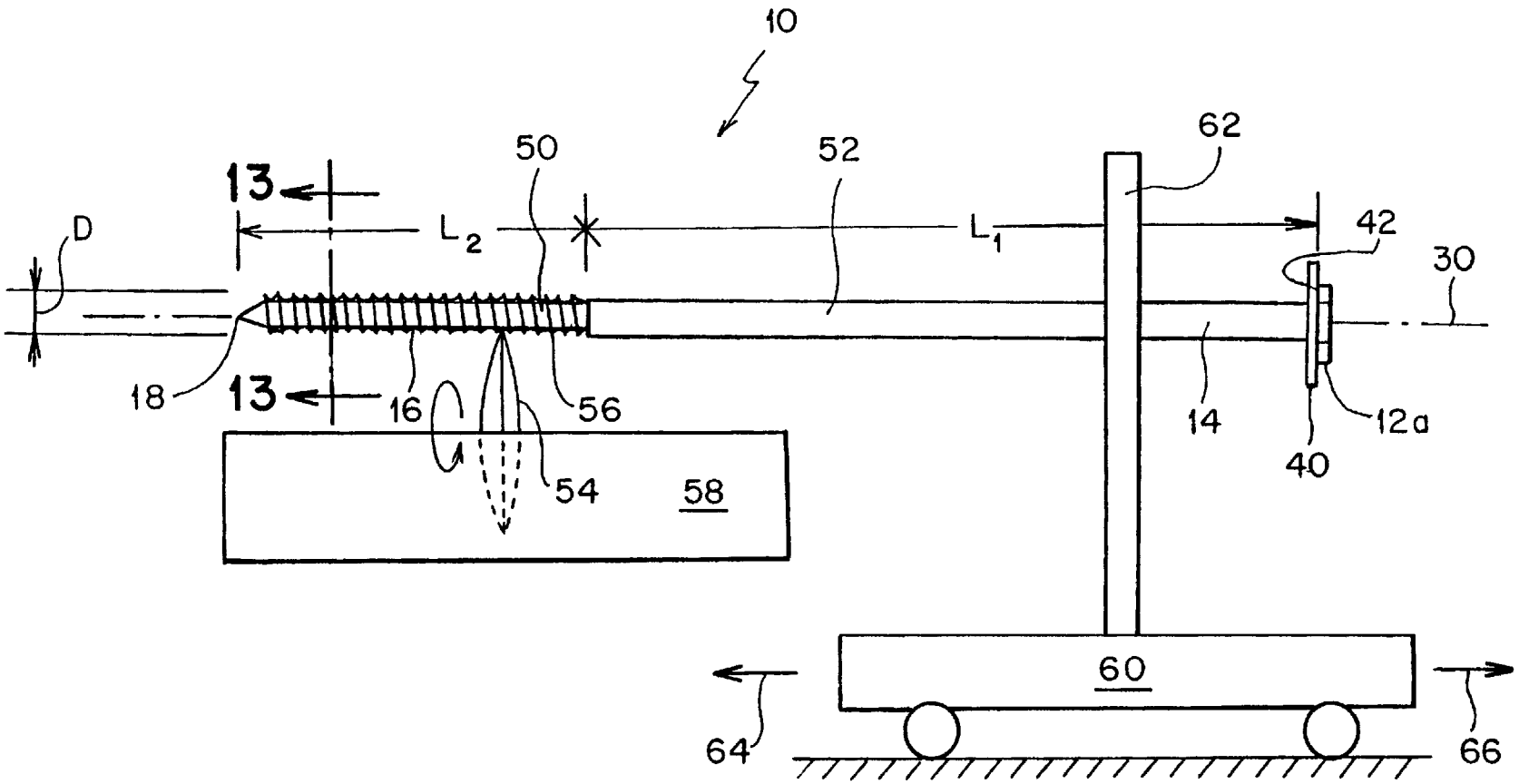
FIG. 12 is a plan view of the manufacturing technique for producing the unique threading of gutter bolt of the invention.

The method of manufacture is shown in FIG. 12. In order to achieve the degree of pitch and angle needed for the threads of the invention, it was not possible to use prior art lathing or rolling to manufacture the threading. These prior art techniques were not able to produce the correct pitch angle and depth in the threads needed for using the gutter bolts without pilot holes.

It was therefore decided to carry out the cutting of the threads 50 into an aluminum metal rod 52 by using a 30,000 rpm cutting blade 54 to cut one angle on the front 56 of the thread as the rod was going into and through the cutter machine 58. Then, instead of ejecting the bolt after one cutting pass, the bolt was pulled back through the cutter and to contact the cutting blade to cut it again to give the correct angle and cutting edge to the threads front edge by the return pulling of the gutter bolt past the blade in the reverse direction. The movement of the rod relative the blade 54 is by means of the mobile attachment device 60 that has holding means 62 for gripping the rod 52 and for moving it in the forward direction 64 and in the reverse direction 66. In doing so, this technique of double cutting of the front edge of the thread enables the bolt threads to be able to be drilled into the pieces of wood without splitting the wood. The gutter bolt actually drills its own pilot hole for the threads as it penetrates the wood. Thus, the gutter bolt drills like a drill bit and holds like a screw. Therefore, it takes a double cutting of the front portion of the thread of the gutter bolt to produce the steep slope thread front portion and to provide the shallow almost flat portion behind that front portion. By double cutting it at the front part of the thread, this gives the threads the sharpness needed to cut into wood like a drill bit. Only the front of the thread is cut during the reverse cutting pass 66 through the cutter machine 58.

Figure 13:
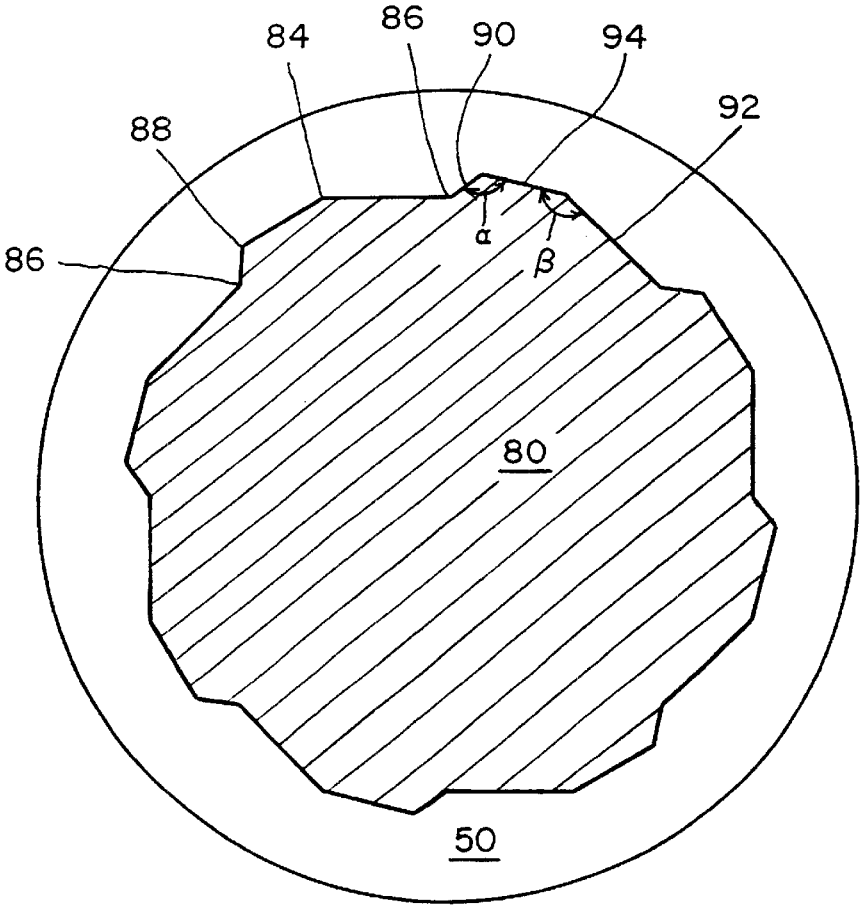
FIG. 13 is a section view along line 13—13 of FIG. 12 showing facets added to the screw threaded portion of the fastener.
Figure 14:
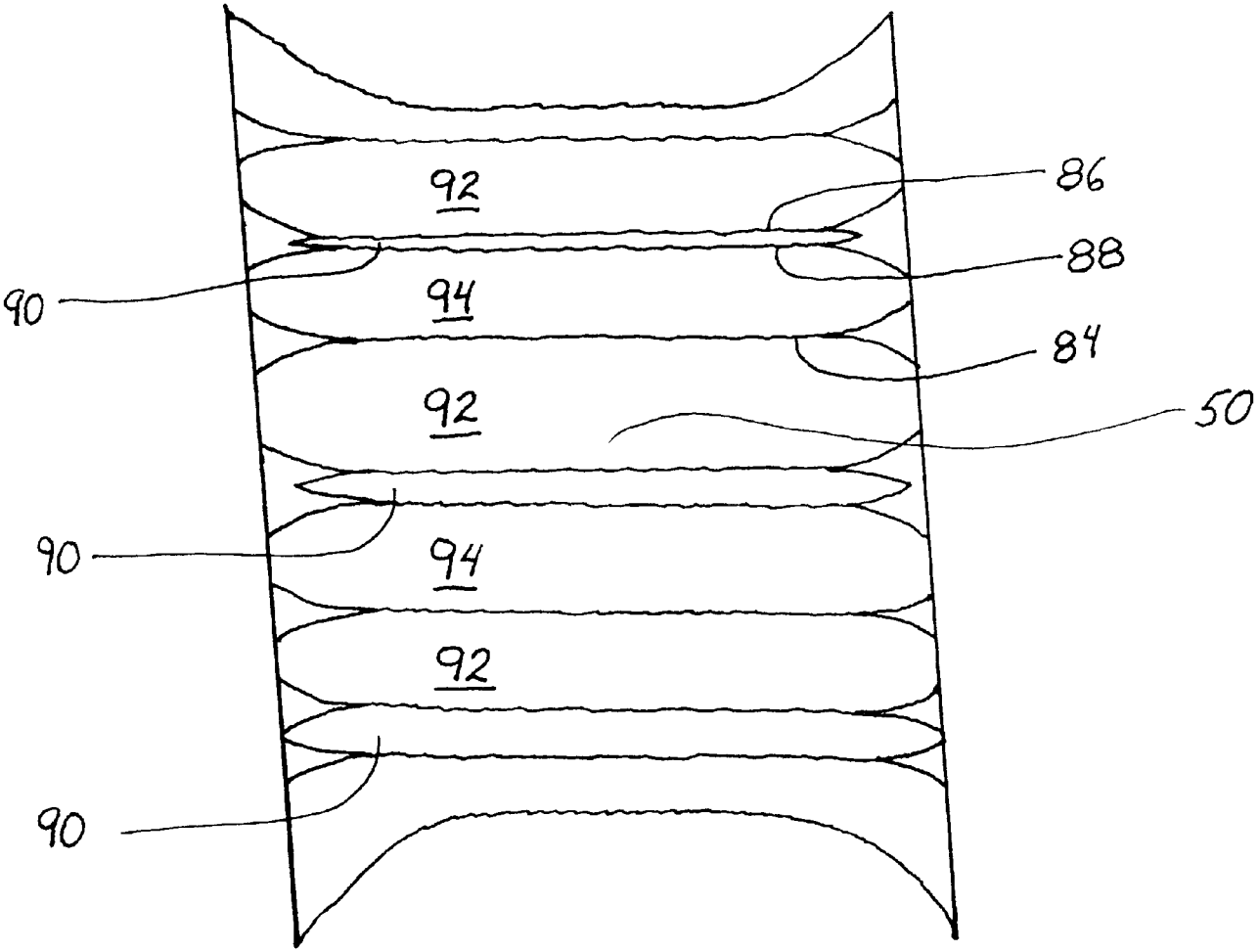
FIG. 14 is an enlarged side view of the fastener thread according to an embodiment of the invention.

FIGS. 13 and 14 show the embodiment in which facets 80 are added to the screw portion of fastener threads 50 for wood screw installation to reduce the torque required. Facets 80 are notches 82 cut or rolled in between each thread of the fastener. Facets 80 reduce torque on the head, rod, threading, tools and reduce stress on material. Facets 80 are shaped multiangle and do not exceed the highest or lowest point of the threading. They are a separate embodiment of the screw portion. Facets are located on the remaining shallow curved portion behind the thread and in between each of the threads.

Facets are recessed at different angle pitches allowing wood to pass over the highest point 84 of the facet into a notched pitched angle. This relieves the stress on the wood as the fastener screws into the wood. The facet gives the wood a chance to expand and contract. With the turning penetration into the wood of the threaded fastener, each individual thread allows this process to happen.

The angle of the facet reduces stress in the wood. As the wood slides up to the next facet, it gradually builds up torque until it reaches the highest point 84 of the facet. This equals the amount of pressure of a solid rod fastener without facets until it rolls over into the cavity or lowest portion 86 of the facet. With many facets placed randomly or in an exact location on each thread having multiple threads per inch, relief of stress will occur on each individual thread. Between the highest point 84 and the lowest point 86 is the intermediate point 88 of the facet.

With the facets in place, the screw portion of the fastener holds better in wood. When unscrewing (counterclockwise rotation) the threaded portion from the wood, the wood now slides up to the highest point 84 of the facet. The wood has to overcome the resistence to removal at the maximum height 84 of the facet. On the other hand, it is easier for the wood to slide down to low point 86 when the fastener advances into the wood (clockwise rotation).

By adding facets to the shallow portion between the threads, it is necessary to slow down the turning RPM of the cutting blade of the rod. This is shown in FIG. 12. This leaves the cutting blade in one area longer and permits a deeper cut notch at random or controlled depths and sizes. Thus there can be a variable number of facets for each individual thread. The method for manufacturing the facets is based upon utilizing the procedure described above for FIG. 12. FIG. 13 shows 8 facets.

The angles of the facets vary in degrees. The angle $\alpha$ is subtended between points 86-88-84 and ranges between 90° to 120°. The angle $\beta$ is subtended between points 88-84-86 and ranges between 130° to 160°. This allows screwing the fastener portion into the wood to turn with the threads causing fibers of wood to conform to the low-high angles of the facet.

The facet has three sections of unequal length, namely the shortest length 90, the longest length 92 and the intermediate length 94. The intermediate length 94 connects the shortest length 90 to the longest length 92. The angle $\alpha$ is located at the intersection of the shortest length section 90 and the intermediate length section 94. The angle $\beta$ is located at the intersection of the intermediate length section 94 and the longest length section 92.

EXAMPLE 1

Comparative testing was conducted with a torque wrench. Five fasteners were used in each of three groups to screw in the threaded portion of a rod ¼"×2" into Douglas fir construction-grade lumber. All fasteners had 11 threads per inch. The average results for the groups were as follows:

| GROUP | TORQUE REQUIRED FOR INSTALLATION |
|---|---|
| (1) Prior Art wood threading | 13 to 15 foot pounds. |
| (2) Wood threading of the invention without facets | 10 to 12 foot pounds. |
| (3) Wood threading of the invention with facets | 7 to 9 foot pounds. |

Thus substantially less torque is required to install a fastener according to the invention as compared to the prior art.

EXAMPLE 2

A comparison for using gutter bolts of the invention as opposed to prior art gutter fasteners when using a standard ¾" pine facia board is demonstrated. Standard 7" or 8" gutter nails are used for fastening gutters, as shown in the Marulic U.S. Pat. No. 4,888,920. The normal spacing for all gutter fasteners is 2½ to 3 feet apart. Due to weather conditions, gutter nails tend to loosen after a year or two. The nails can even fall out if the weather conditions are severe, causing damage to the gutters and facia board which could allow water to seep into the house or basement. When installing gutters, gutter nails tend to split the facia board when they are inserted too close to the edge of the wood. Also, the nails will bend when they hit something solid, for example a knot in the wood or the rafter tail. Gutter nails tend to bend when using pressure treated wood.

Comparison testing for removing a gutter nail from wood was conducted. A gutter nail was removed from a ¾" thick piece of pine wood. It took 60 pounds of pressure to pull it out. If installing a 25' gutter using 10 gutter nails, there is 600 pounds of holding force for the 25' gutter.

As shown by the hidden hanger of the Faulkner U.S. Pat. No. 5,388,377, when using the front edge of gutter for support, its strength depends on the diameter of the gutter materials. This can range from 0.019 inch to 0.032 inch. When using a 0.032 inch clip edge, it takes approximately 50 pounds of pressure for the clip to rip from the gutter, leaving the front of the gutter unsupported. Also, it is not possible to reclip the hidden hanger due to damage to the gutter lip from the hanger when screwing back the portion of the hanger to the facia board. From highest back point of gutter to lowest back point of gutter, there is damage to the edge of the roof overhang into the gutter when screwing the hidden hanger into the facia board. An example of the strength of a usual hidden hanger is as follows. When using 10 hidden hangers per 25' of gutter, you have 500 pounds of support holding the front and the bottom of the gutter. Since the screws for the hangers are metal, over time they tend to rust and you have metal fatigue. Since the front clip would not fit tightly to the gutter lip, there is movement.

Gutter bolts of the invention are a unique improvement. For example, there is full control when installing the gutter bolts. There is no more swinging of a hammer or leaning over the gutter from a ladder to screw in a hidden hanger. Gutter bolts are screwed in with an electric drill or 12 volt cordless drill. There is a reduced chance of an accident happening because of more control when fastening the gutter bolts. It is possible to use aluminum gutter bolts to install aluminum gutters, or to use copper gutter bolts for installing copper gutters. There is no mixing of metals. When fastening gutter bolts, they go right through knots in the wood, rafter tails or extremely hard woods. Gutter bolts do not need pilot holes. Gutter bolts do not split the wood even when being installed close to the edge of the wood.

It takes about 875 pounds to remove a gutter bolt of the invention from a ¾" pine board. If there is a 25' gutter and the gutter bolts are spaced 2½' apart, or installing 10 gutter bolts, there would be 8,750 pounds holding up a 25' gutter that weighs 20 pounds. If only 5 gutter bolts were used on a 25' gutter, there would be 4,375 pounds of holding force for a 20 pound gutter. The holding force for the gutter bolt of the invention greatly surpasses all existing prior art gutter fasteners, as can be seen from the prior art test results of 500 to 600 pounds for the prior art fasteners.

While several embodiments of the present invention have been shown and described, it is to be understood that many changes and modifications may be made thereunto without departing from the spirit and scope of the invention as defined in the appended claims.

What is claimed is:

1. A fastener having opposing ends, a longitudinal axis, a radius, and a threaded portion and an unthreaded portion coaxially arranged along said longitudinal axis, wherein the threaded portion consists of a helical groove recessed into an outer surface of the fastener defined by the radius, the fastener comprising:

a plurality of facets disposed serially within and extending transverse to the helical groove, said facets being operable to reduce the torque required to drive said fastener into a work object.

2. The fastener according to claim 1, wherein each of said plurality of facets comprise different lengths, and points having varying radial distances with respect to each other and the longitudinal axis.

3. The fastener according to claim 2, wherein said points further comprise a high point, an intermediate point and a low point, each of said high point, intermediate point and low point having a different radial distance from the longitudinal axis with respect to each other, each of said different radial distances being smaller than the radius of the fastener outer surface.

4. The fastener according to claim 2, wherein said different lengths comprise a short length, an intermediate length and a long length, said short length being defined as the distance between said low point and said intermediate point, said intermediate length being defined as the distance between said intermediate point and said high point, said long length being defined as the distance between said high point and said low point.

5. The fastener according to claim 4, further comprising a first angle defined by an intersection of said short length and said intermediate length.

6. The fastener according to claim 5, wherein said first angle is in a range of 90°–120°.

7. The fastener according to claim 4, further comprising a second angle defined by an intersection of said intermediate length and said long length.

8. The fastener according to claim 7, wherein said second angle is in a range of 130°–160°.

9. The fastener according to claim 1, further comprising a head integrally formed with the opposing end on the unthreaded portion, said head adapted to receive a tool for driving the fastener into the work object.

10. A fastener having opposing ends, a longitudinal axis, an outer surface defined by a first radial distance from the longitudinal axis, and a threaded portion and an unthreaded portion coaxially arranged along said longitudinal axis, wherein the threaded portion consists of a helical groove recessed into the outer surface of the fastener, said helical groove having a second radial distance defined as the radial distance from the longitudinal axis to a lowest point of the helical groove, the fastener comprising:

a plurality of facets disposed within and extending transverse to the helical groove and having different lengths and points, said different points having different radial distances with respect to each other, wherein said different radial distances are greater than the second radial distance formed by the helical groove and less than the first radial distance of the outer surface.

11. The fastener according to claim 10, wherein said points further comprise a high point, an intermediate point and a low point, each of said high point, intermediate point and low point having a different radial distance from the longitudinal axis with respect to each other, each of said different radial distances being smaller than the first radial distance of the fastener.

12. The fastener according to claim 10, wherein said different lengths comprise a short length, an intermediate length and a long length, said short length being defined as the distance between said low point and said intermediate point, said intermediate length being defined as the distance between said intermediate point and said high point, said long length being defined as the distance between said high point and said low point.

13. The fastener according to claim 12, further comprising a first angle defined by an intersection of said short length and said intermediate length.

14. The fastener according to claim 12, further comprising a second angle defined by an intersection of said intermediate length and said long length.

15. The fastener according to claim 14, wherein said first angle is in a range of 90°–120°.

16. The fastener according to claim 15, wherein said second angle is in a range of 130°–160°.

* * * * *